US007086561B2

(12) United States Patent
Bosanac

(10) Patent No.: US 7,086,561 B2
(45) Date of Patent: Aug. 8, 2006

(54) GOLF BALL DISPENSER

(76) Inventor: Steven Charles Bosanac, 871 SE. 14th Ave., Deerfield Beach, FL (US) 33441

( * ) Notice: Subject to any disclaimer, the term of this patent is extended or adjusted under 35 U.S.C. 154(b) by 277 days.

(21) Appl. No.: 10/715,021

(22) Filed: Nov. 17, 2003

(65) Prior Publication Data

US 2004/0094565 A1 May 20, 2004

Related U.S. Application Data

(60) Provisional application No. 60/426,494, filed on Nov. 15, 2002.

(51) Int. Cl.
*B65G 59/00* (2006.01)

(52) U.S. Cl. ..... 221/279; 224/919

(58) Field of Classification Search ..... 221/279, 221/199, 285, 247; 294/19.2; 224/269, 224/919, 918; 194/19.2
See application file for complete search history.

(56) References Cited

U.S. PATENT DOCUMENTS

| | | | | |
|---|---|---|---|---|
| 2,962,321 | A | 11/1960 | Fowler et al. | |
| 5,147,101 | A | 9/1992 | Tiller | |
| 5,839,607 | A * | 11/1998 | Swanson | 221/231 |
| 6,386,607 | B1 | 5/2002 | Deininger | |
| 6,439,424 | B1 * | 8/2002 | Threadgill, Jr. | 221/185 |
| 6,457,317 | B1 | 10/2002 | O'Donnell | |
| 6,523,718 | B1 | 2/2003 | Chan | |

* cited by examiner

*Primary Examiner*—Kenneth Noland

(57) ABSTRACT

A tubular golf ball-dispensing container holds multiple golf balls for individual distribution. The container includes a biased lid for selectively loading and unloading of golf balls. A spring loaded compression system presses the stack of golf balls into the lid for continuous dispensing of individual balls. Upon removal of a ball from the container, the biased lid closes and the next ball is forced into the dispensing cup in the lid. The container may be attached to other gold equipment including golf bags, golf carts, and pull carts. With the addition of a support structure, the container may stand alone, a usefully configuration for use at a driving range.

13 Claims, 10 Drawing Sheets

GOLF BALL DISPENSER

CROSS-REFERENCE TO RELATED APPLICATION

This application claims the benefit of U.S. Provisional Patent application 60/426,494 originally filed Nov. 15, 2002 under 35 U.S.C. 119(e).

TECHNICAL FIELD

The present invention relates to golf equipment. More particularly, the present invention relates to storing a set of golf balls within a golf ball dispenser until each golf ball in the set is individually dispensed from a vertically advantageous position.

BACKGROUND AND RELATED ART

A golfer must generally carry several extra golf balls in his golf equipment bag. Typically, these extra golf balls are stored in one of the lower, zippered pockets of the golf equipment bag. These same pocket compartments are also used to store other items including tees, scorecards, pencils, money, personal items, and other golf paraphernalia.

Depending on the difficulty of the golf course, some golfers may require additional golf balls during the course of play. Typically, these ill-fated golfers are required to rummage through the pocket compartments of their golf equipment bag for another golf ball. In addition to the mere physical awkwardness of squatting next to the golf equipment bag to perform the search, there are other negative consequences resulting from attempts to retrieve extra golf balls while playing. One unfortunate consequence of this rummaging activity is that other items, such as keys, money, scorecards, or other golf miscellany that are stored in the pocket compartments may accidentally be dropped and subsequently lost on the golf course. Moreover, access to these pocket compartments is often further impeded when the golf equipment bag is strapped to a golf cart.

Some golfers avoid rummaging for replacement golf balls by keeping a few extra golf balls in their pockets or on the golf cart. Unfortunately, these options also have disadvantages. For example, not only can the extra golf balls be distracting to a golfer's swing when kept in pockets, but the extra balls may also result in confusion about which golf ball the golfer is officially playing. Alternatively, when the extra balls are placed in the golf cart, they are either loose underfoot or, worse, the extras may often be forgotten at the end of the round and left in the cart.

SUMMARY OF THE INVENTION

In view of these difficulties previously associated with known methods for dispensing golf balls and the limitations of available solutions, the present invention has been developed to satisfy the need for a portable device to carry and dispense golf balls. More specifically, the golf ball dispenser allows a golfer to retrieve golf balls, one at a time, from near the top of the golf bag instead of the lower pockets.

It is accordingly an object of the invention to provide a golf ball dispenser that overcomes the hereinafore-mentioned disadvantages of the heretofore-known devices of this general type.

Other features that are considered as characteristic for the invention are set forth in the appended claims.

Although the invention is illustrated and described herein as embodied in a golf ball dispensing method, system, and apparatus, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

Additional features and advantages of golf equipment for dispensing golf balls with a vertically elevated delivery point will be set forth in the description that follows, and in part will be obvious from the description, or may be learned by the practice of dispensing golf balls using a golf ball dispenser. The features and advantages of golf equipment for dispensing golf balls with a vertically elevated delivery point may also be realized and obtained by the instruments and combinations particularly pointed out in the appended claims.

BRIEF DESCRIPTION OF THE DRAWINGS

The embodiments of the invention are illustrated by way of example, and not by way of limitation, in the figures of the accompanying drawings in which like reference numerals refer to similar elements. In the drawings.

DETAILED DESCRIPTION OF THE PREFERRED EMBODIMENTS

In the following description, numerous specific details are set forth. However, it is understood that embodiments of the invention may be practiced without these specific details. In other instances, well-known structures and techniques have not been shown in detail in order not to obscure the understanding of this description.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification do not necessarily all refer to the same embodiment.

Figure 1A:
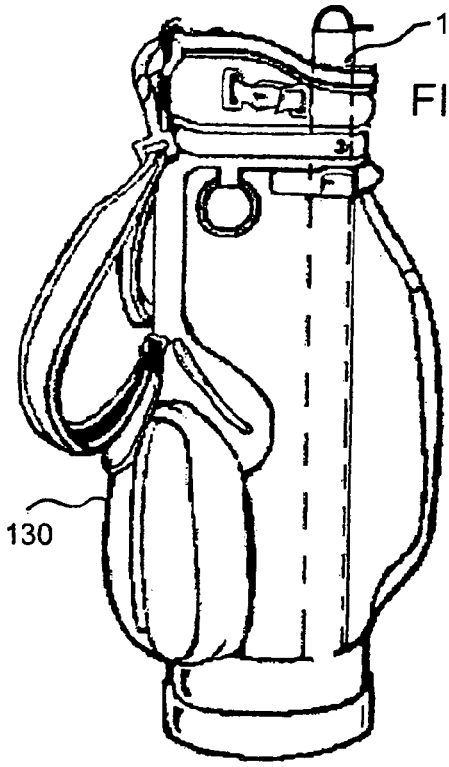
FIG. 1A is a perspective view from a side of a first operating environment for a ball dispenser system using a golf ball dispenser according to the invention.
Figure 1B:
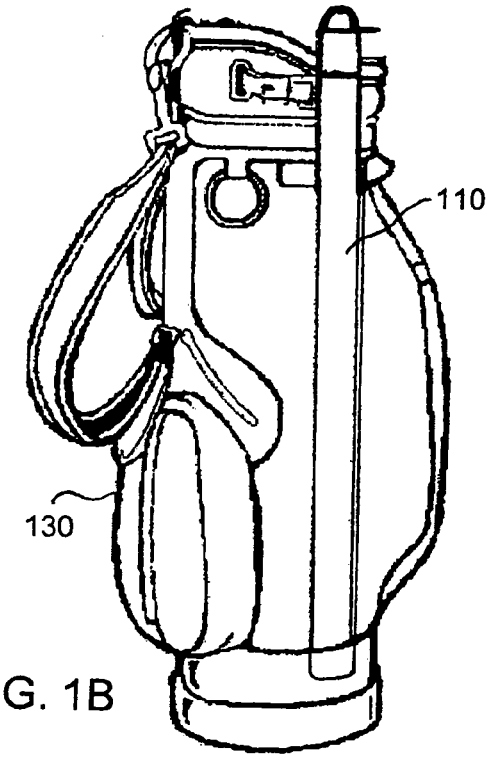
FIG. 1B is a perspective view from a side of the first operating environment for a second embodiment of the ball dispenser according to the invention.
Figure 1C:
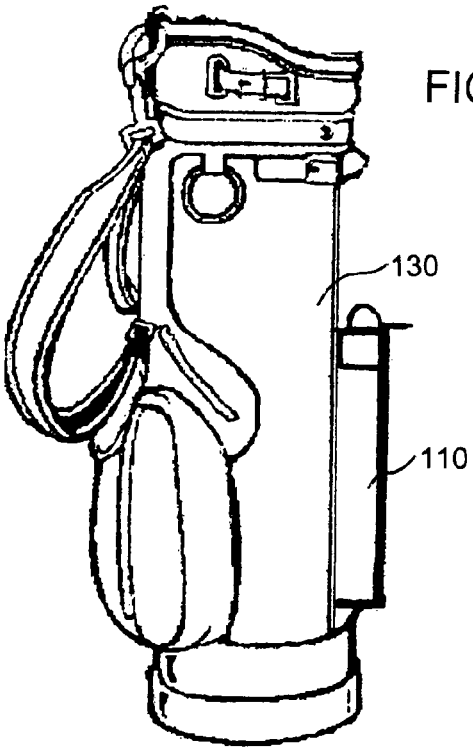
FIG. 1C is a perspective view from a side of the first operating environment for a third embodiment of the ball dispenser according to the invention.

FIGS. 1A to 1D and the following discussion are intended to provide a brief, general description of suitable environments for the dispenser according to the present invention. Referring now to the figures of the drawings in detail and first, particularly to FIGS. 1A to 1C thereof, there is shown a first embodiment, in the form of a golf equipment bag 130, that includes a golf ball dispenser 110 loaded with golf balls 120 (see FIG. 3). In FIG. 1A, the golf ball dispenser 110 is loaded into the club compartment and, preferably, releasably clipped to the edge of the golf bag 130. FIG. 1B illustrates an alternative embodiment, in which a smaller golf ball dispenser 10 is integrated at the golf equipment bag 130. FIG. 1C illustrates another configuration where the golf ball dispenser 110 is attached to the exterior of golf bag 130, whether removably or fixedly.

Figure 1D:
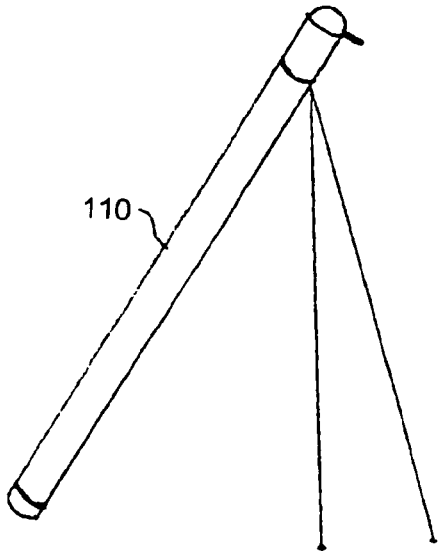
FIG. 1D is a perspective view from a side of a second operating environment for a ball dispenser system using a golf ball dispenser according to the invention.

A second environment, illustrated in FIG. 1D, shows the golf ball dispenser 110 disposed in a stand-alone tripod configuration.

The term "golf cart" as used in the instant application, refers to a variety of different types of equipment used to transport golf equipment on a golf course, such as pushcarts, pull carts, electric motorized carts, golf cars, and riding carts. Pushcarts and pull carts are two- or three-wheeled carts, with a vertical support with a variety of holders for attaching the cart to a bag. Electric golf carts or electric motor caddies are similar in shape and form to the push or pull carts, but come with a built-in motor. Motorized riding carts or golf cars are vehicles to drive golfers and their equipment around the course.

Figure 2:
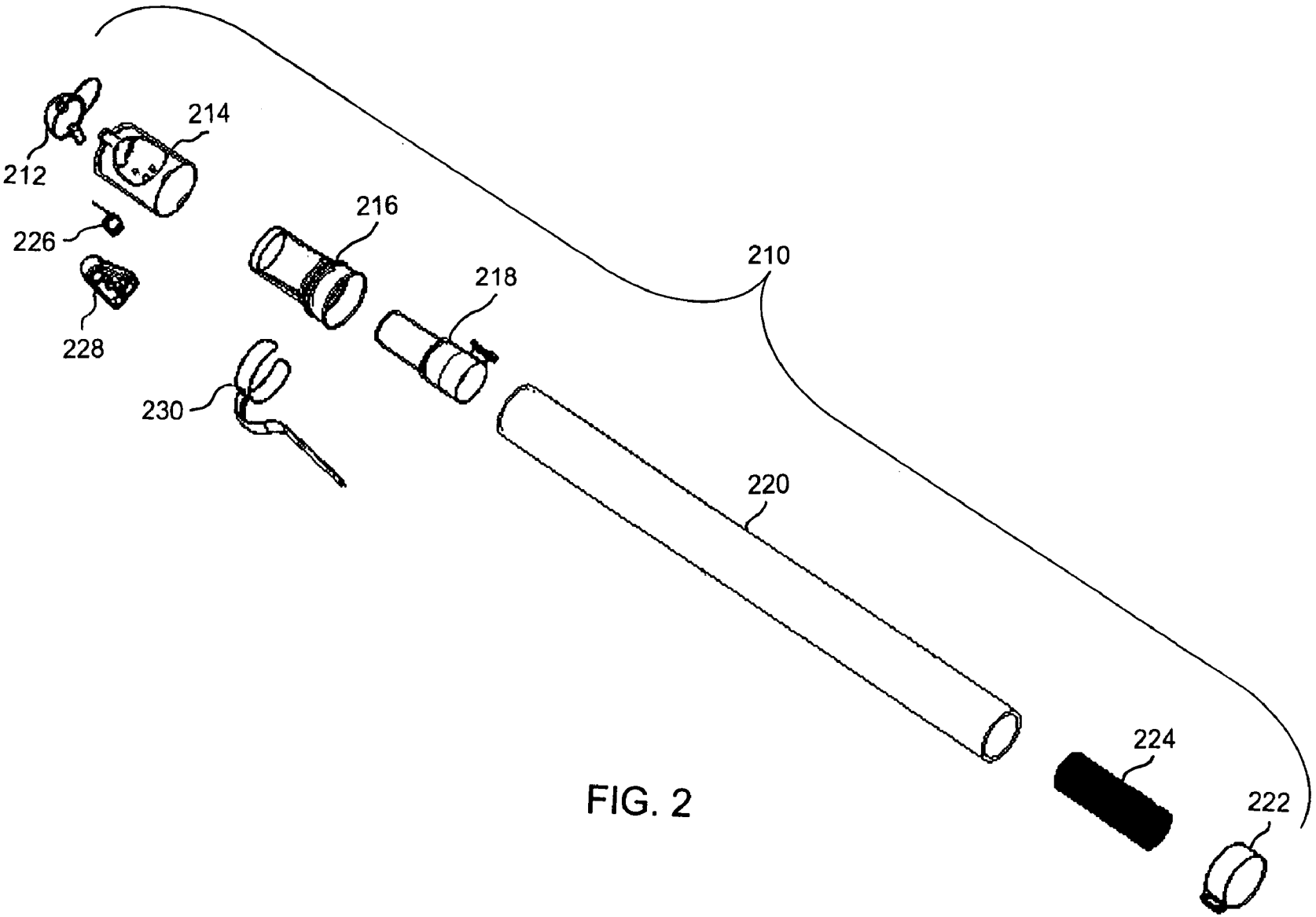
FIG. 2 is an exploded perspective view of a golf ball dispenser for a ball dispenser system according to the invention.

FIG. 2 illustrates an exploded schematic view of a golf ball dispenser 210 according to one embodiment of the present invention. The golf ball dispenser 210 includes a ball interface and a tubular container. One embodiment of the ball interface includes a flip top lid 212, a turret 214, and an interior housing 216. As previously indicated, clip 230 enables the golf ball dispenser 210 to be attached removably to the golf bag or golf cart. One embodiment of the tubular container includes a piston 218, a vertical biasing device 224, a substantially cylindrical tube 220, and a bottom cap 222.

The flip top lid 212 is operably coupled to the turret 214 such that the lid 212 may revolve about an axis substantially orthogonal to a longitudinal axis of the tube 220 between closed and open positions. The turret 214 is rotatably coupled to the interior housing 216 such that the turret may turn relative to the interior housing portion 216 around the longitudinal axis. In one configuration, the flip top lid 212 is biased towards a closed position. The closed position biasing being provided by the combination of the turret 214, a biasing coil or spring 226, and biasing cover 228.

Figure 3:
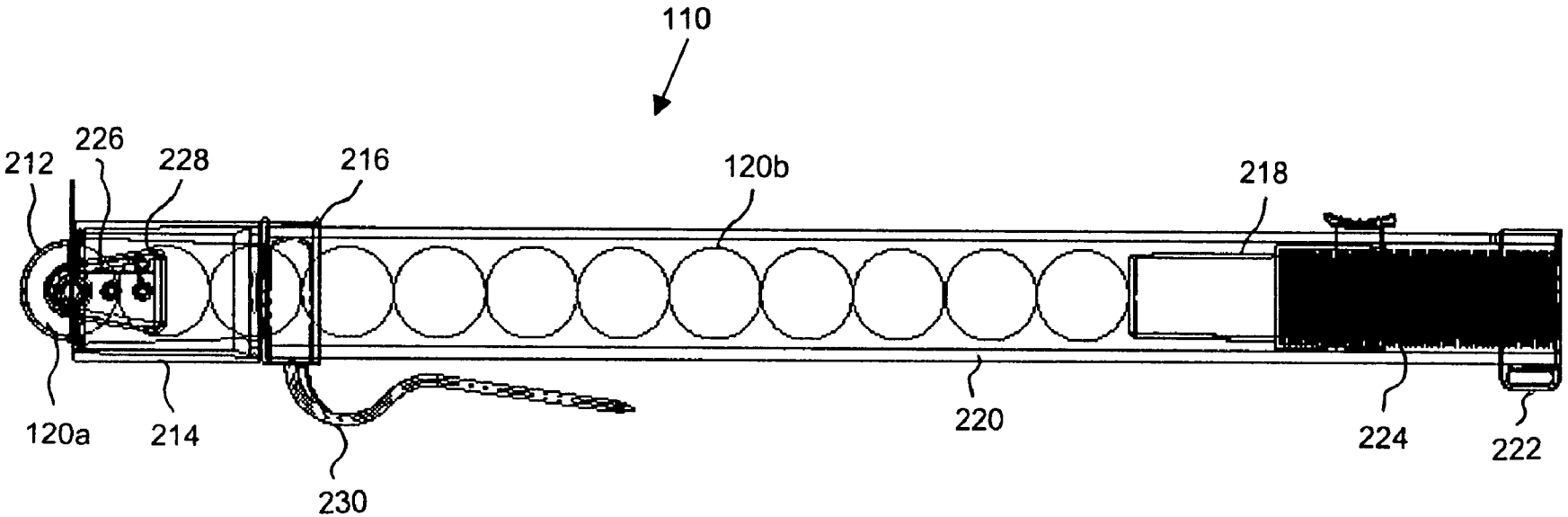
FIG. 3 is a partially cross-sectional and partially broken away view of the golf ball dispenser according to the invention exhibiting a loaded state with twelve golf balls positioned within.

FIG. 3 illustrates a cross-sectional view of a golf ball dispenser 110 loaded with golf balls 120 according to one embodiment of the present invention. As previously discussed, one embodiment of the golf ball dispenser includes a flip top lid 212, a turret 214, an interior housing 216, a piston 218, a substantially cylindrical tube 220, a bottom cap 222, and a vertical biasing device 224.

As golf balls are generally packaged for sale in boxes of twelve to eighteen balls, various tube lengths may be used for the substantially cylindrical tube 220 to accommodate a full box set of golf balls 120. See FIGS. 1A and 1C. The width of the cylindrical tube 220 is determined by the golf balls and the type of vertical adjustment mechanism used to position the golf balls 120 once loaded into the dispenser 110.

One embodiment of the tubular container 220 illustrated in FIG. 3 includes an automatic vertical adjustment mechanism for positioning golf balls within the substantially cylindrical tube 220. The illustrated vertical adjustment mechanism includes a biased piston 218 and a vertical biasing device 224. Exemplary vertical biasing devices 224 for use in the vertical adjustment mechanism include a spring mechanism, an elastic mechanism, a ratchet mechanism, a threaded mechanism, or other similar vertical biasing mechanisms.

The biased piston 218 helps to position the balls 120*a*, 120*b* within the golf ball dispenser 110. The piston 218 is vertically biased through a vertical biasing device 224, which is, in the case of a preferred embodiment, a spring mechanism, to properly position the loaded golf balls 120*a*, 120*b* within the substantially cylindrical tube 220. Exemplary biasing measures include deforming a spring, through compression or elongation, during or prior to a loading phase. More specifically, the vertical biasing device 224, in this case a deformed compression spring mechanism, exerts a restoring force on the piston 218 that, in turn, lifts the golf balls 120*a*, 120*b* towards the flip top lid 212. Once an individual or single top golf ball 120*a* is pressed into the flip top lid 212, the ball 120*a* is deemed to be in a dispensing position and the golf ball dispenser 110 is loaded. As such, the top golf ball 120*a* is the next ball to be dispensed upon actuation of the flip top lid 212.

Figure 4:
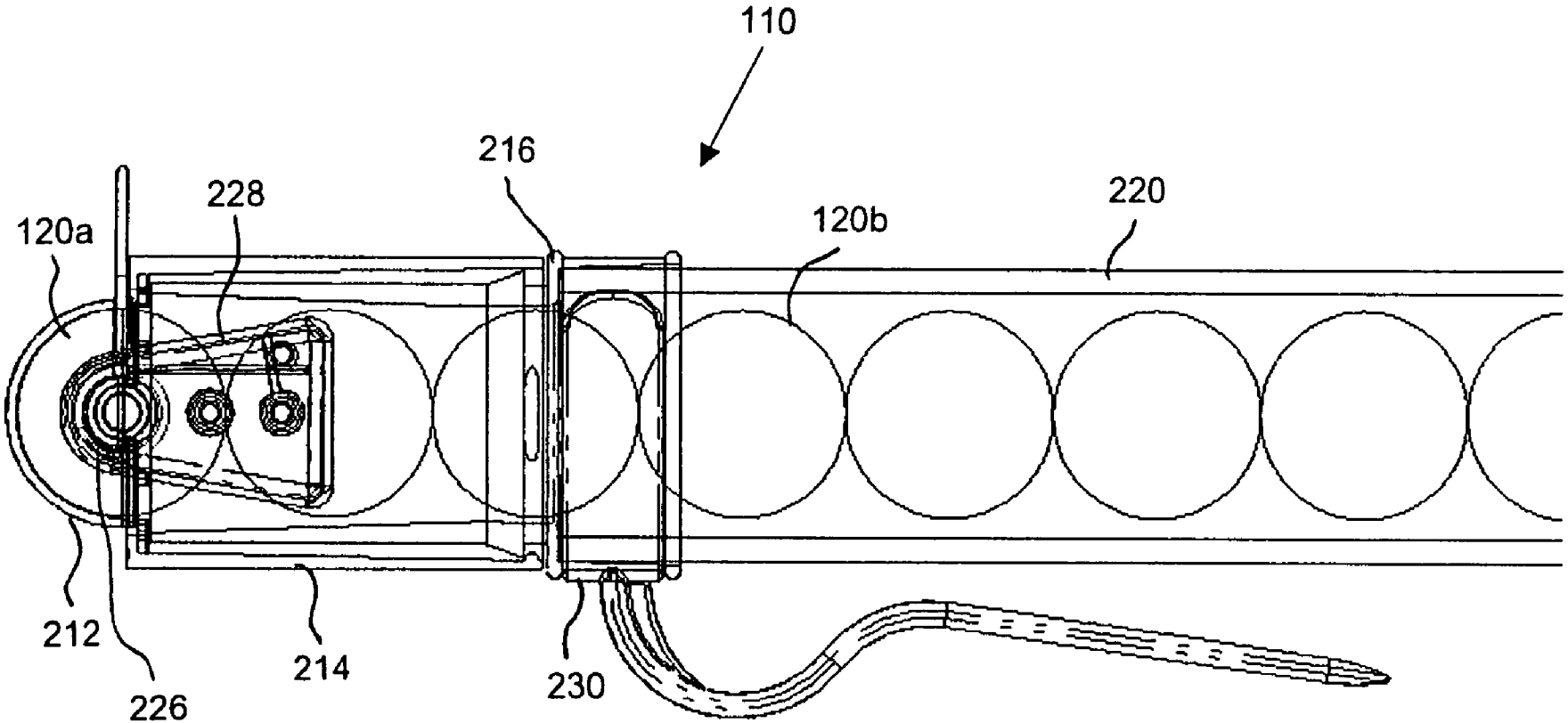
FIG. 4 is a fragmentary partially cross-sectional and partially broken away view of the golf ball dispenser with the top end including a ball interface according to the invention.

FIG. 4 illustrates a close-up of the cross-sectional view of the top end of the golf ball dispenser 110 loaded with stacked golf balls 120*a*, 120*b*. More specifically, FIG. 4 illustrates one embodiment of the ball interface including the flip top lid 212, the turret 214, the interior housing 216, biasing coil or spring 226, and the biasing cover 228.

The turret 214 and biasing cover 228 hold the biasing spring 226 in position to bias the lid 212. Although the illustrated flip top lid 212 in FIG. 3 is biased towards a closed position, alternative configurations in which the lid is biased towards an open position or a dispensing position may also be used without departing from the spirit or characteristics of the present invention.

The clip 230 enables the golf ball dispenser 110 to be attached to a golf bag or golf cart. While the clip 230 is illustrated in FIG. 4, other acceptable attachment methods include using a strap or snap, each of which may be removably or fixedly connected to the dispenser 110. In one embodiment illustrated in FIG. 1D, the clip 230 is replaced by a stand with multiple support legs to form at least a tripod support structure with the endcap 222. Such a configuration allows the golf ball dispenser 110 to be a stand alone device, which could be used at a driving range or practice green, for example.

Figure 5:
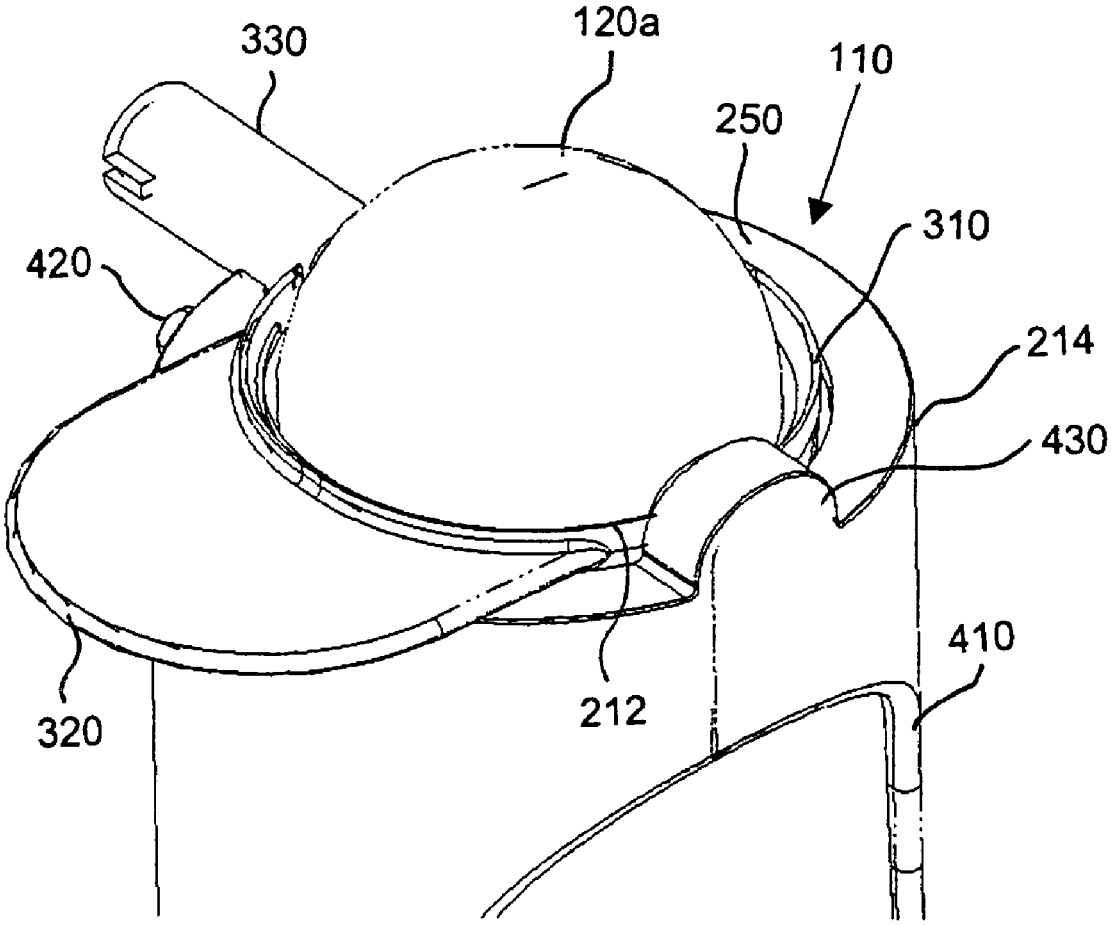
FIG. 5 is a fragmentary perspective view from above the golf ball dispenser according to the invention exhibiting a dispensing position.
Figure 6:
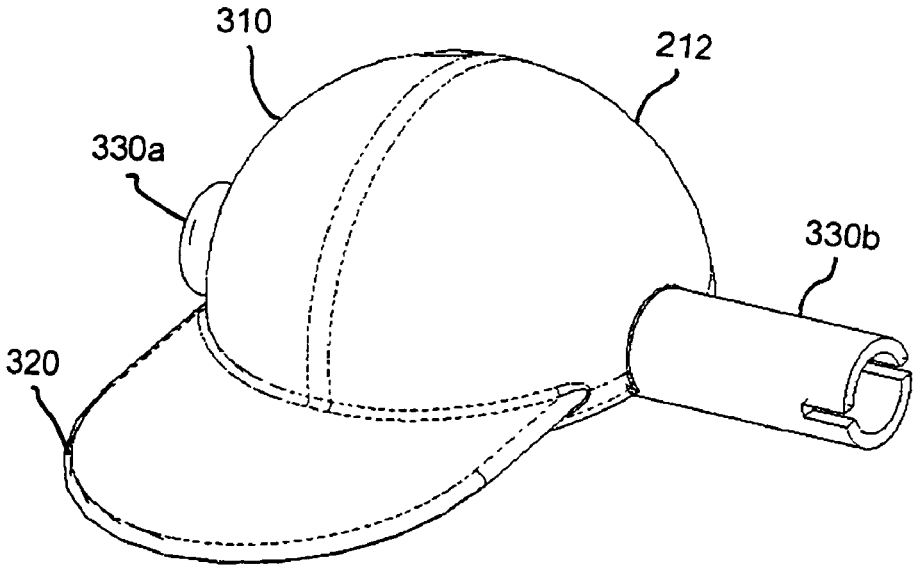
FIG. 6 is a perspective view from above the flip top lid according to the invention.

FIGS. 5 and 6 illustrate the process of dispensing a golf ball 120*a* from the flip top lid 212 located on the top end 250 of the golf ball dispenser 110. The flip top lid 212 includes a scoop portion 310, a lever portion 320, and an axle 330, 330*a*, 330*b* having a substantially horizontal axis around which the lid 212 may rotate from a closed position to an open or dispensing position. Upon rotation about the axis, scoop portion 310 separates the top golf ball 120*a* from the other loaded golf balls 120*b*. FIG. 5 also provides a closer perspective view for one embodiment of turret 214 having a loading interface 410, a biasing interface 420, and axle support structure 430.

Although the lid 212 is typically biased towards the closed position, FIG. 5 illustrates that the golf ball dispenser 110 may also work without a biasing coil 226. Specifically, the vertical adjustment mechanism, by forcing the balls to the top end 250 of the golf ball dispenser 110, allows actuation of the lid 212, by rotation about the orthogonal axis to the longitudinal axis and, thereby, allow a user to grab the top ball 120*a* from the scoop 310 of the dispenser 110.

While FIGS. 2–5 only illustrates one golf ball dispensing system 110, several other configurations are acceptable and within the scope of at least one embodiment. For example, one embodiment of the ball interface 410*c* illustrated in FIGS. 1E, 15, and 16 only holds a top cap portion of the golf ball in the fixed top 212*b* so that the golf ball can be removed from an interface opening using only two fingers, such as the thumb and forefinger, placed at substantially opposite sides of the golf ball. In this manner, the dispensing ball interface 410*c* is always open. While most embodiments use different interfaces to load and dispense the golf balls, one embodiment illustrated in FIGS. 1E, 15, and 16 of the ball interface uses the same opening to load and dispense the golf balls. Embodiments of the present invention may use a dispensing interface with either a vertical opening or a horizontal opening. Moreover, some embodiments may use either a horizontal opening or a vertical opening as a loading interface.

FIG. 6 is a perspective view of a flip top lid 212 according to one embodiment of the present invention. The flip top lid 212 is a cap shaped component including a scoop portion 310, a lever portion 320, and axles 330*a*, 330*b*. The scoop portion 310 is curved to approximately match the curvature of the golf ball. As was previously indicated in FIG. 5, the lid 212 separates the top ball 120*a* from the remaining balls 120*b*. The lever portion 320 is moved approximately 180 degrees from a closed position to a dispensing position. The axles 330*a*, 330*b* may be biased to one position, preferably, the closed position, so that the lid 212 returns to the closed position once force is removed from the lever portion 320. The illustrated axles 330 are notched and of different sizes, but alternative configurations are also within the scope of the present invention. For example, both sides or neither side of lid 212 could be biased depending on the desired design features.

Figure 7:
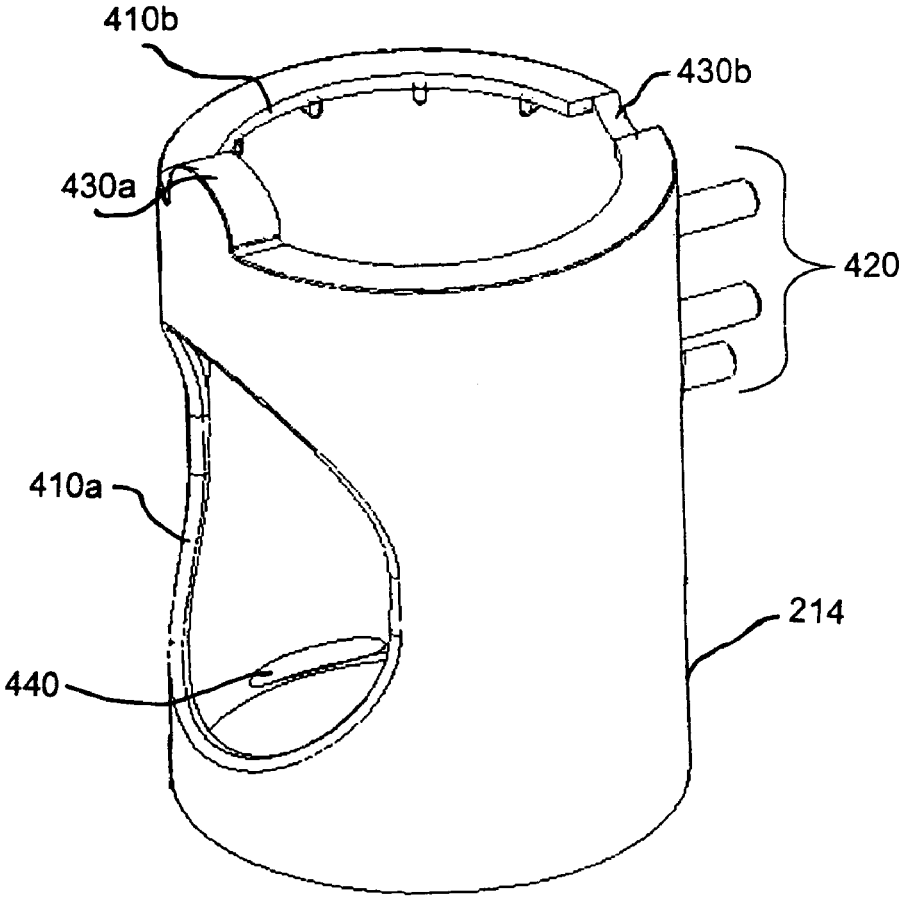
FIG. 7 is a perspective view from above the rotating turret according to the invention.

FIG. 7 illustrates the turret 214 according to one embodiment of the present invention. The turret 214 includes ball interfaces 410*a* and 410*b*, axle interfaces 430*a* and 430*b*, and biasing interface 420. The turret interacts closely with the flip top lid 212 of FIG. 6 and the interior housing 216 of FIG. 10. More specifically, the dispensing ball interface 410*b* includes axle interfaces 430*a* and 430*b* to receive the axles 330*a* and 330*b* respectively. The illustrated turret 214 also includes a thread portion 440 that fits within the guide track 710 of the interior housing 216 and enables the turret 214 to rotate from a closed position to a loading position. In the loading position, the ball interface 410*a* is aligned with a similar loading interface 730 in the interior housing 216.

Figure 8:
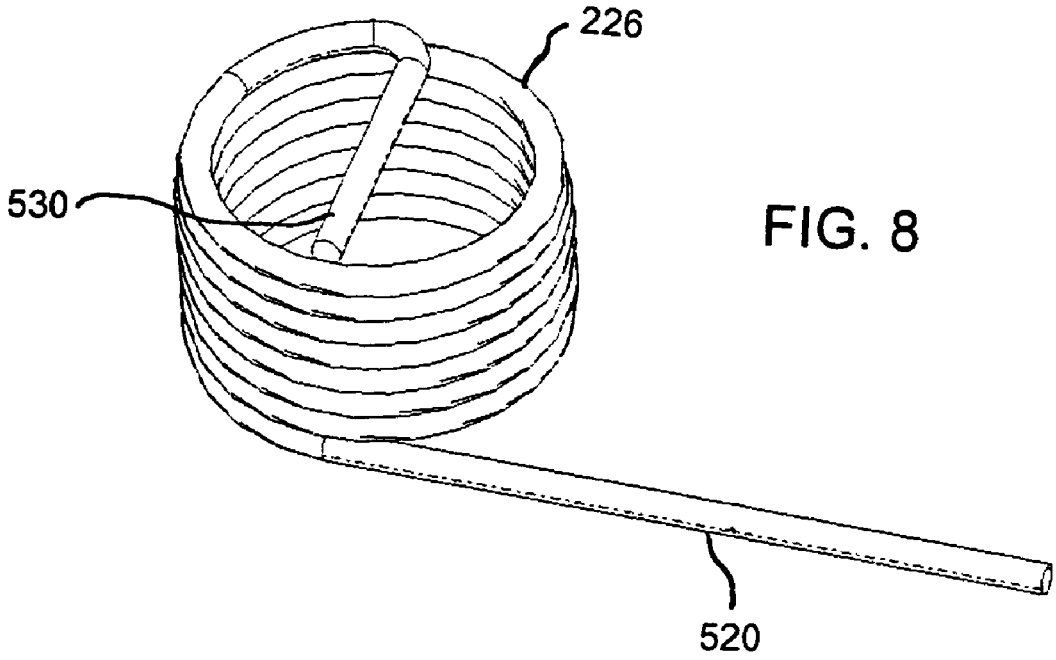
FIG. 8 is a perspective view from above the biasing spring according to the invention.
Figure 9:
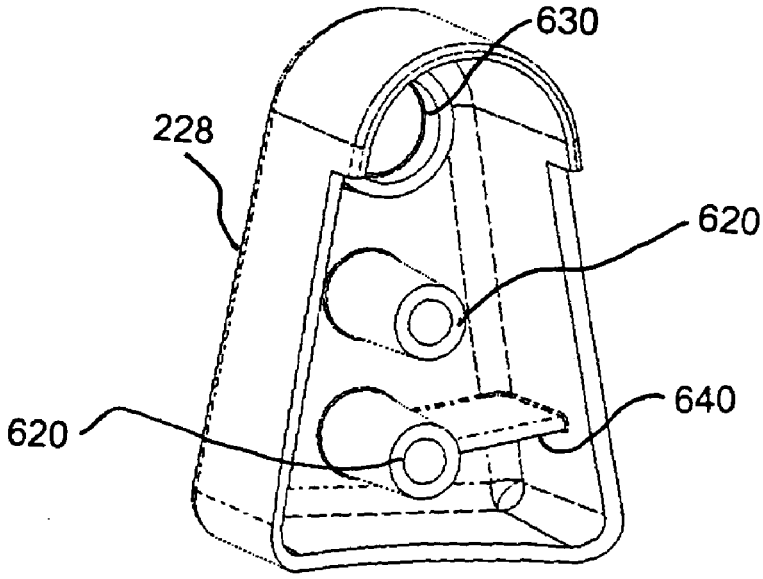
FIG. 9 is a perspective view from above a flip top biasing cover according to the invention.

The biasing interface 420 couples with the biasing cover 228, as illustrated in FIG. 9, to proper position the biasing coil or spring 226 illustrated in FIG. 8. The biasing cover 228 includes positional columns 620, an axle interface 630, and a biasing barrier 640. As previously illustrated in FIGS. 3 and 4, the biasing spring 226 is positioned between the cover 228 and the turret 214 to hold a leverage arm 520 on the biasing spring 226 between the biasing interface 420 on the turret 214 and the positional columns 620 of the biasing cover 228. The biasing barrier 640 positions and provides cross-dimensional support for the leverage arm 520. The notched axle 330*b* couples with the bias arm 530 of the biasing spring 226 and extends through the axle interface 630 of the biasing cover 228.

Figure 10:
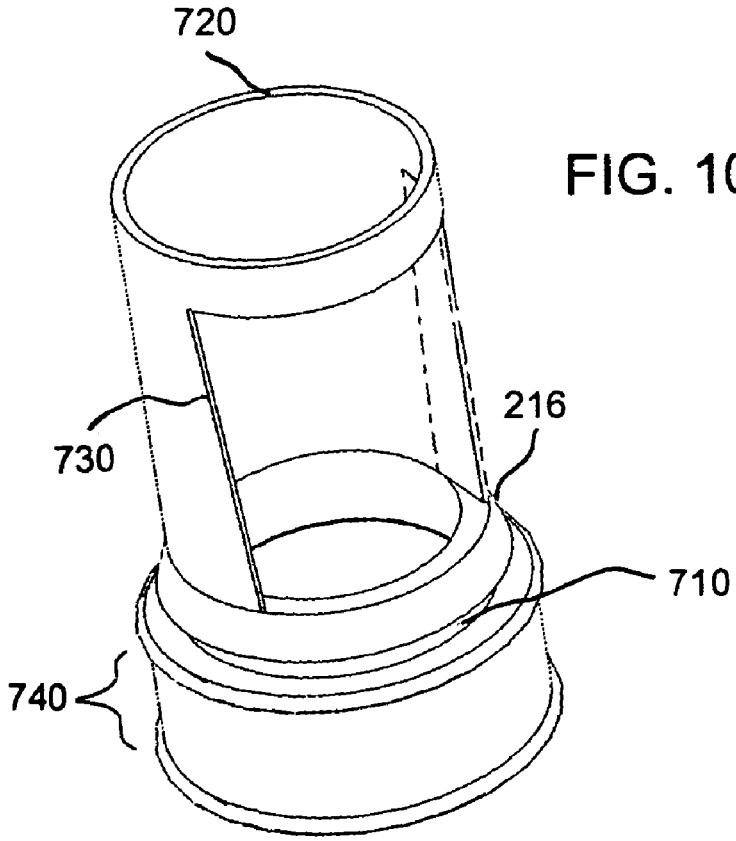
FIG. 10 is a perspective view from above an interior housing portion of a ball interface according to the invention for loading and dispensing golf balls.

FIG. 10 illustrates an interior housing portion 216 of a ball interface according to one embodiment of the present invention. The interior housing 216 includes a guide track 710, a dispensing interface 720, a loading interface 730, and a clip interface 740. The interior housing 216 is generally fixably coupled to the substantially cylindrical tube 220, but can be removably coupled thereto. The clip interface 740 is configured to receive a clip 230, strap, or other attachment mechanism to fasten or position the golf ball dispenser 110 in a desired location. In one embodiment set forth above, the dispensing interface 720 and the loading interface 730 use the same opening.

Figure 11:
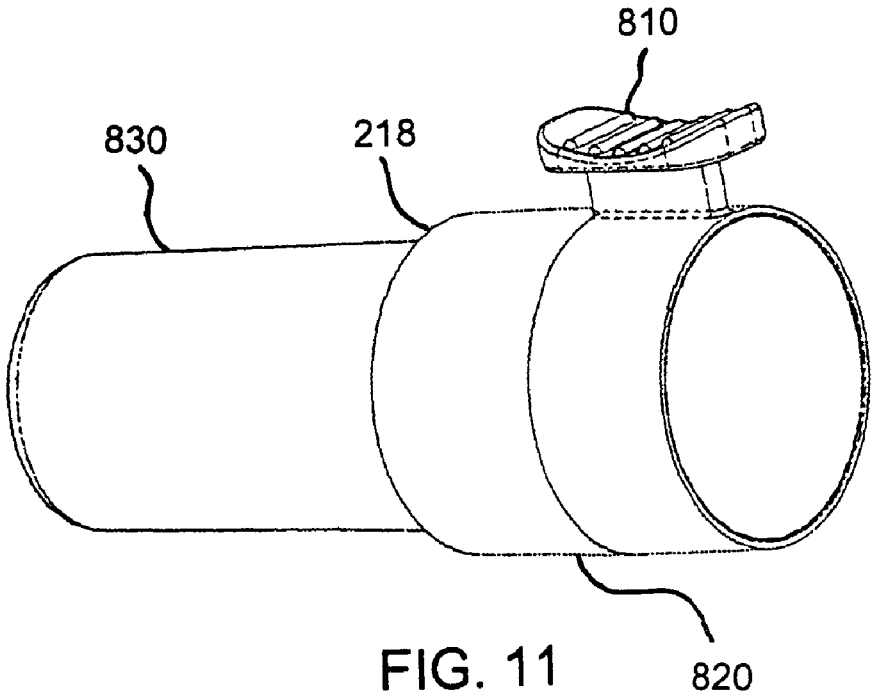
FIG. 11 is a perspective view from a side of the interior piston according to the invention.

FIG. 11 illustrates the interior piston 218 according to one embodiment of the invention. The piston 218 includes a finger toggle 810, an outer cylinder 820, and a plunger 830. The outer cylinder 820 of the piston 218 is configured to receive the vertical biasing device 224 (illustrated in FIG. 13) therewithin through opening 840 and to slide within a cavity 930 of the substantially cylindrical tube 220 (see FIG. 12). As illustrated in FIG. 3, the plunger 830 presses (through a non-illustrated plate at the leftmost end of the plunger as viewed in FIG. 11) the loaded golf balls 120 towards the dispensing opening. The plunger 830 has a smaller diameter as it is configured to fit within the interior housing 216 and press the last golf ball into the top golf ball position 120*a*.

Figure 12:
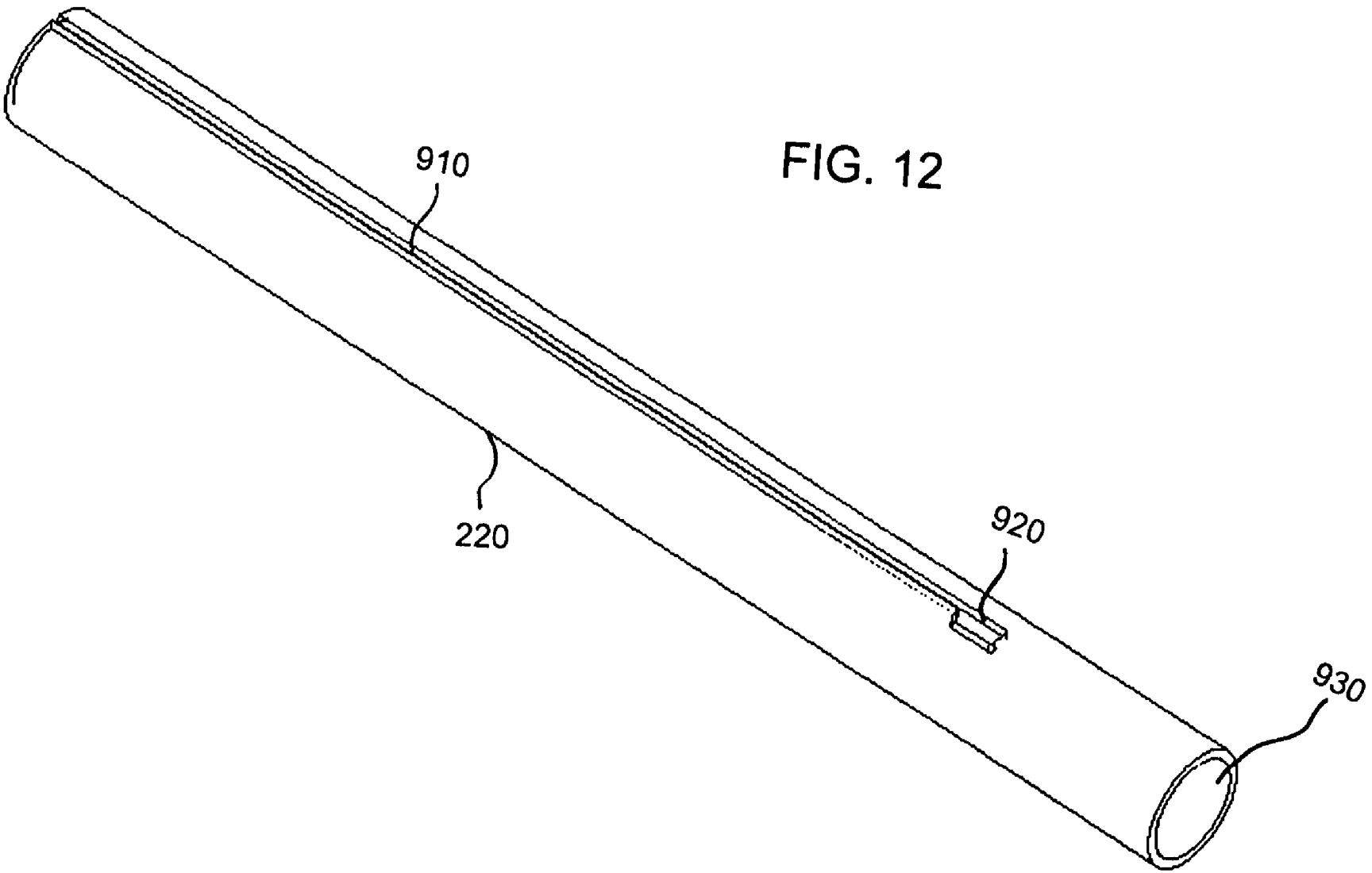
FIG. 12 is a perspective view from above a slotted tube according to the invention.
Figure 13:
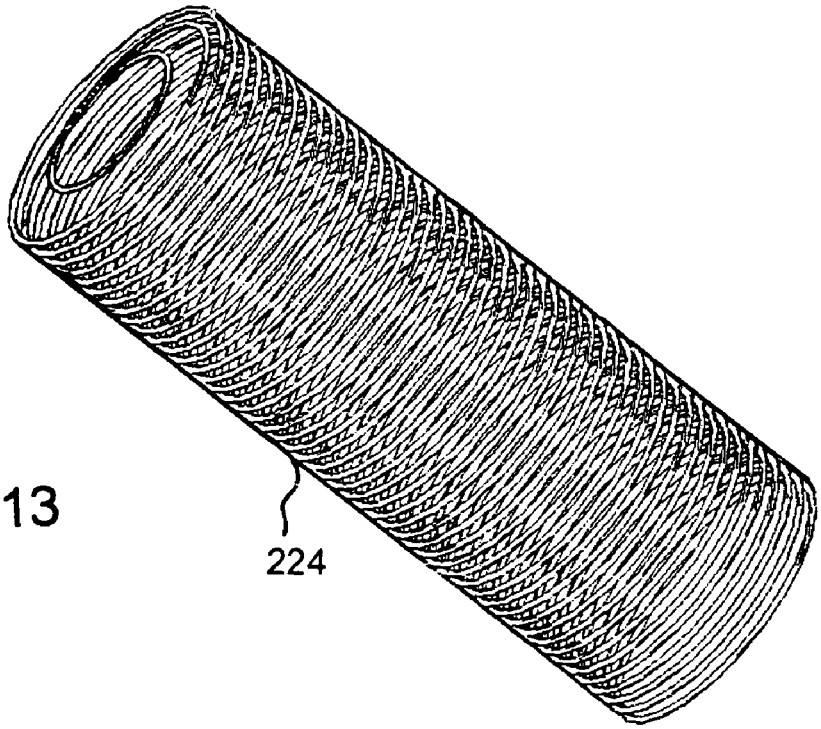
FIG. 13 is a perspective view from above a compressed spring according to the invention.

FIG. 12 illustrates a substantially cylindrical slotted tube 220 according to one embodiment of the present invention. The tube 220 includes a slotted guide track 910, a loading notch 920, and the cavity 930 formed within tube 220 to allow the passage of balls therethrough. The finger toggle 810 of the piston 218 is configured to fit within the slotted guide track 910. If desired, the user may move the finger toggle 810 to the loading notch 920 to move the piston 218 within the cavity 930 and to deform the vertical biasing device 224. Once the balls have been loaded into the dispenser, the finger toggle 810 may be released from the loading notch 920 so that the vertical adjustment mechanism can position the loaded balls 120 for dispensing.

Figure 14:
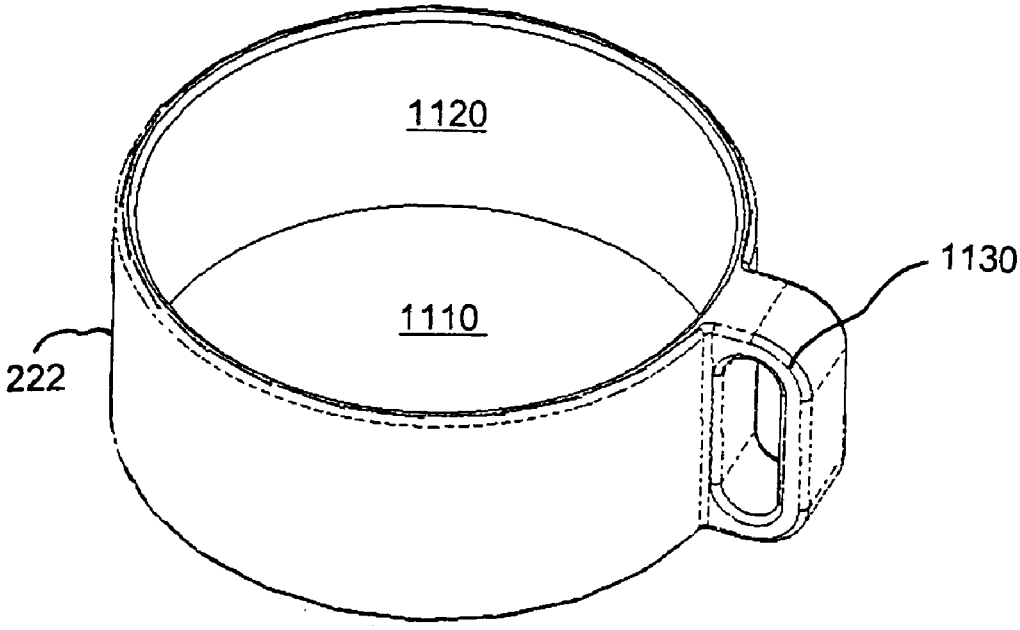
FIG. 14 is a perspective view from above of the bottom cap according to the invention.

The bottom cap 222 illustrated in FIG. 14 includes a bottom surface 1110, a tube interface 1120, and an attachment interface 1130. The vertical biasing device 224, more specifically a compression spring, presses against the bottom surface 1110 to move the piston 218. The tube interface 1120 receives the substantially cylindrical slotted tube 220 and fastens it to the bottom cap 222 such that the biasing device 224 is not able to move the bottom cap 222 from the tube 220. For example, in one embodiment, the tube interface is threaded so that the bottom cap can be screwed onto the tube 220. Another embodiment uses a compression fitting to connect the tube 220 and the bottom cap 222. The illustrated attachment interface 1130 is configured to receive a strap, clip, or hook to attach the dispenser 110 to the desired location.

Several alternative embodiments exist for the design of a ball interface that positions the delivery point near the top of the golf ball dispenser. One exemplary additional embodiment illustrated in FIGS. 1E, 15, and 16 uses a ball interface configured to hold a polar cap portion of the golf ball so that the golf ball can be removed from an interface opening using only two fingers, such as the thumb and forefinger, placed at substantially opposite sides of the golf ball. In one configuration, the interface opening is always open. Alternatively, the golf ball dispenser could be resized to accommodate other types of athletic balls, such as ping-pong balls, tennis balls, racquetballs, squash balls, handballs, baseballs, billiard balls, polo balls, basketballs, and other types of round sporting balls. Further embodiments could reshape the scoop portion 310 to accept alternatively shaped athletic balls or equipments, such as footballs, pucks, or similar equipment.

The present invention may be embodied in other specific forms without departing from its spirit or important characteristics. The described embodiments are to be considered in all respects only as illustrative and not restrictive. Therefore, the scope of the invention is indicated by the appended claims rather than by the foregoing description. All changes that come within the meaning and range of equivalency of the claims are to be embraced within their scope.

What is claimed is:

1. A ball dispensing apparatus, comprising:

a tubular container having a top end;

a ball interface coupled at said top end for dispensing a single ball from said top end; and said tubular container vertically positioning loaded balls at said ball interface;

said ball interface includes a loading position, a dispensing position, and a storage position; said tubular container has a substantially vertical longitudinal axis; said ball interface includes a rotating turret with a flip top lid; said rotating turret selectively slides about said axis from a closed position to said loading position; said flip top lid operationally moves about an axis orthogonal to said longitudinal axis from a closed position to said dispensing position; and said ball interface is in said storage position when said flip top lid and said rotating turret are in said closed position.

2. The apparatus according to claim 1, wherein said ball interface has a vertical apex and is configured to receive a plurality of balls during a loading phase and to deliver a single ball at said vertical apex during a dispensing phase.

3. The apparatus according to claim 2, wherein said ball interface has a selectively removable top to facilitate quick loading of said tubular container.

4. The apparatus according to claim 1, wherein said tubular container has a vertical adjustment mechanism configured to vertically position balls at said ball interface to dispense one ball at a time from said top end.

5. The apparatus according to claim 4, wherein said vertical adjustment mechanism has a piston disposed within said tubular container and at least one deformable spring operatively connected to said piston to move said piston toward said ball interface.

6. The apparatus according to of claim 1, wherein said ball interface has a lid movable between closed and dispensing positions and biased toward said closed position, said ball interface dispensing a single ball each time said lid is moved from said dispensing position to said closed position.

7. The apparatus according to claim 1, wherein said ball interface and said tubular container are sized to accommodate balls selected from the group consisting of golf balls, ping pong balls, tennis balls, racquet balls, squash balls, billiard balls, polo balls, hand balls, baseballs, basketballs, and other substantially round sport balls.

8. A system for individually dispensing golf balls, comprising:

at least one golf ball; and a golf ball dispenser having:

a substantially cylindrical tube having a top end and defining a substantially circular cavity configured to contain said at least one golf ball;

a selectively movable golf ball interface disposed at said top end for dispensing a golf ball from said top end; and a vertical positioning mechanism aligning said at least one golf ball within said substantially cylindrical tube;

wherein said selectively removable top end has a dispensing cap; wherein said dispensing cap, upon actuation, dispenses a single golf ball; wherein said dispensing cap rotates about an axis from a closed position to a dispensing position.

9. The system according to claim 8, wherein said dispensing cap is biased to a closed position.

10. The system according to claim 8, wherein said substantially cylindrical tube includes a slotted groove for locking said vertical positioning mechanism.

11. The system according to in claim 8, wherein said vertical positioning mechanism has a compression spring mechanism positioning said at least one golf ball within said substantially cylindrical tube.

12. The system according to claim 8, further comprising a golf equipment bag supporting said golf ball dispenser in a substantially vertical position.

13. The system according to claim 10, further comprising:

a golf cart supporting said golf equipment bag in a substantially vertical position, said golf cart being selected from the group consisting of push carts, pull carts, electric motorized carts, golf cars, and riding carts; and said golf ball dispenser being positioned in a substantially vertical position on said cart to dispense said at least one golf ball from said top end.

* * * * *